United States Patent [19]

Mason

[11] 4,222,177

[45] Sep. 16, 1980

[54] APPARATUS FOR CURING PHOTO-DEVELOPING INKS

[76] Inventor: Ronald M. Mason, 6 Weerona Pl., Caringbah, New South Wales, Australia, 2229

[21] Appl. No.: 888,145

[22] Filed: Mar. 20, 1978

[30] Foreign Application Priority Data

Apr. 18, 1977 [AU] Australia ..... 9790/77

[51] Int. Cl.[2] ..... F27B 3/28

[52] U.S. Cl. ..... 34/4; 34/39; 34/41; 250/514; 362/318

[58] Field of Search ..... 34/4, 39, 41; 362/218, 362/318; 250/527, 504, 514

[56] References Cited

U.S. PATENT DOCUMENTS

| | | | |
|---|---|---|---|
| 2,380,682 | 7/1945 | Boerstler | 362/318 |
| 3,811,828 | 5/1974 | Ohta et al. | 34/4 |
| 3,991,484 | 11/1976 | Lamb et al. | 34/4 |
| 4,000,407 | 12/1976 | Keller et al. | 262/218 |
| 4,143,278 | 3/1979 | Koch | 34/4 X |

*Primary Examiner*—John J. Camby

*Attorney, Agent, or Firm*—Christie, Parker & Hale

[57] ABSTRACT

Method of drying photo developing ink printed on sheet material, said method comprising the steps of conveying the sheet material through a developing zone below a line source of ultra-violet light, the line of said source lying at an angle to the direction of conveying movement with a reflector behind the line source so that both direct and reflected ultra-violet rays are directed towards the sheet material, with a transparent heat sink filter for infra-red rays disposed between the sheet material and the ultra-violet light source to filter between 5 and 50% of all of the direct rays from the source.

15 Claims, 10 Drawing Figures

APPARATUS FOR CURING PHOTO-DEVELOPING INKS

This invention has application to the printing industry and in particular provides means for curing what is referred to in the printing trade as photo-developing inks, or more commonly ultra-violet inks. Such inks by the application of ultra-violet rays cure into a finished "dried" condition.

In this field it is already known to provide a line light-source of high intensity which is commonly a mercury tube giving off both infra-red and ultra-violet rays, see U.S. Pat. Nos. 3,991,484 and 4,00,407. As a printed sheet or web is passed below the line source it is scanned by the line light-source and the rays emitted from the light-source cure (dry) the ink onto the base material.

Because mercury lamps (tubes) have the desired ray emission they are preferred to other sources of UV rays. Mercury lamps however operate at a temperature exceeding 450° C. and when they are operating there is a great deal of heat generated. This heat is a problem in the curing of ultra-violet inks because of the detrimental effect such heat has on the base material onto which the printed image has been deposited. Sheet stock material will curl due to heat and if not passed beneath the lamp at an appropriate rate, scorching, charring and even fire can result from the sheet stock being overheated.

Early developments tried to overcome the heat problem by providing a high speed continuous feed. An early arrangement comprised one or more mercury tubes each with a reflector which partially surrounded the lamp at the side remote from the printed material. The printed material was therefore subject to both direct and reflected radiation. The reflected radiation was concentrated by the reflector to give a narrow band of high intensity radiation at a set distance from the light source. With this apparatus it was imperative that the printed material was maintained mobile and travelled at a speed which did not allow it to reach ignition temperature. This arrangement cured all ink thicknesses. The problem with this arrangement was the maintenance of the desired feed rate. With high speed feed as used, momentary slow down or a feeding jam resulted in burned, ruined product.

A number of attempts have been made to overcome the heat problem. The attempts have been aimed at reducing the heat output of the lamp whilst at the same time retaining the ultra-violet ray intensity of the lamp. The former has been considered as detrimental to ink curing whilst the latter is essential to the curing process.

One such attempt involved a light source housed within a reflector (as before) but the path of all direct and reflected rays was blocked by a transparent barrier. The barrier comprised transparent material enclosing a flowing, cooling liquid. By way of example, this could be achieved by locating the light source in the inner of two concentric transparent tubes and passing water through the annulus therebetween. In another form, as shown in U.S. Pat. No. 4,000,407 the mouth of the reflector was completely blocked by two side-by-side tubes through which water was passed or by a rectangular shaped tube which extended across the mouth of the reflector and through which water was passed.

This latter apparatus worked efficiently on thin ink deposits. By thin is meant ink deposits in the order of 5 to 10 microns thick as would be deposited in printing processes known as litho.

The apparatus was totally inadequate for ink thicknesses in the order of 15 to 127 microns which is a quite common ink thickness deposit in the field of screen printing. At best with screen printed work a surface cure of the ink was achieved but no depth of cure was possible. The ink was therefore surface hard but soft underneath. Extended exposure had no appreciable effect on the depth of cure.

Recognising the shortcomings of both of the foregoing apparatus the present Applicants have developed apparatus which enables screen printing ink deposits to be adequately cured (dried).

Broadly, the present invention can be described as a housing through which screen printed material is conveyed below a line light-source emitting both ultra-violet and infra-red radiation. A reflector partially encircling the light source reflects both ultra-violet and infra-red radiation towards the conveyor and interposed between the light-source and the conveyor there is a transparent conduit through which cooling liquid is passed. The amount of radiation passing through the cooling liquid is controlled within a range to give effective curing. From experiments it has been found that the intensity of ultra-violet radiation rather than the amount is a critical factor in gaining penetration sufficient to cure the ink. Additionally, it is essential to have some unfiltered radiation impining on the sheet indicating that some infra-red rays are needed to effect proper ink cure. The above deductions were arrived at from the following experimentation involving FIGS. 1 to 5 in which:

FIG. 1 shows schematically a reflector backed mercury vapour tube spaced at a first distance from a printed sheet moving past the zone of radiation, FIG. 2 shows the arrangement of FIG. 1 with water flowing through a transparent conduit below the ray focus to absorb infra-red wave heat, FIG. 3 shows the arrangement of FIG. 2 with the conduit aligned with the ray focus, FIG. 4 shows the arrangement of FIG. 2 with the conduit above the ray focus, and FIG. 5 schematically shows a known arrangement of U.S. Pat. No. 4,000,407.

| | |
|---|---|
| Rays shown | and identified 16 indicate REFLECTED, FILTERED RAYS |
| Rays shown | and identified 13 indicate REFLECTED UNFILTERED RAYS |
| Rays shown | and identified 14 indicate DIRECT UNFILTERED RAYS |
| Rays shown | and identified 15 indicate DIRECT FILTERED RAYS |

FIG. 1 shows a mercury vapour lamp 10 and a reflector 11 in a housing 12 with rays focusing at a distance of 103 mm from the centre of lamp 10 and 76.2 m from the reflector 11. Both the reflected rays 13 and direct rays 14 have an uninterrupted path to the printed surface of the stock 20 which is shown at a distance of 230 mm from the lamp centre and 204 mm from the reflector base.

Cure results obtained immediately after exposure to a curing lamp were, in the case of screen printing a white photo-curable coating (approx. 25 microns depth) onto a coated surfaced stock through a nylon mesh No. 200S-GT coated with a direct photo emulsion:

| | |
|---|---|
| Maximum Conveyor Speed for acceptable ink ADHESION to Stock | - 157 Feet Per Minute |
| Maximum Conveyor Speed for resin post TACK test | - 117 F.P.M. |
| STOCK TEMPERATURE: | @ 57 F.P.M. - 49° C. |
| STOCK TEMPERATURE: | @ 22 F.P.M. - 65.6° C. |
| FILTERED REFLECTED ENERGY 16 | - 0% |
| FILTERED DIRECT ENERGY 15 | - 0% |

FIG. 2 shows the same configuration as FIG. 1 with a 40 mm diameter hollow tube 17 (e.g. quartz, vicor, pyrex, etc) positioned with its centre 166 mm from the lamp centre and 140 mm from the reflector 11. This tube has a liquid infra-red filtering medium recirculating through it (e.g. water). The centre of lamp 10, the reflected ray focus point 21 and centre of the hollow tube are all in line and perpendicular to the surface of the stock 20. Repeat test results were:

| | |
|---|---|
| Maximum Conveyor Speed for acceptable ink ADHESION to Stock | - 157 F.P.M. |
| Maximum Conveyor Speed for resin post TACK test | - 100 F.P.M. |
| STOCK TEMPERATURE | @ 57 F.P.M. - 46° C. |
| STOCK TEMPERATURE | @ 22 F.P.M. - 60° C. |
| FILTERED REFLECTED ENERGY 16 | - 50% |
| FILTERED DIRECT ENERGY 15 | - 13% |
| UNFILTERED DIRECT ENERGY 14 | - 87% |

FIG. 3 shows the same configuration as FIG. 2 with the hollow tube 17 in a new height position 90 mm from tube centre to lamp centre and 63.5 mm from tube centre to reflector base. Repeat test results were:

| | |
|---|---|
| Maximum Conveyor Speed for acceptable ink ADHESION to Stock | - 117 F.P.M. |
| Maximum Conveyor Speed for resin post TACK test | - 38 F.P.M. |
| STOCK TEMPERATURE: | @ 57 F.P.M. - 39° C. |
| STOCK TEMPERATURE: | @ 22 F.P.M. - 43.3° C. |
| FILTERED REFLECTED ENERGY 16 | - 100% |
| FILTERED DIRECT ENERGY 15 | - 23.5% |

-continued

| | |
|---|---|
| UNFILTERED DIRECT ENERGY 14 | - 76.5% |

FIG. 4 shows the same configuration as FIG. 3 with the hollow tube 17 in a new height position 65 mm from the tube centre to lamp centre and 38.2 mm from tube centre to reflector base. Repeat test results were:

| | |
|---|---|
| Maximum Conveyor Speed for acceptable ink ADHESION to Stock | - No adhesion at 5 F.P.M. |
| Maximum Conveyor Speed for resin post TACK test | - 22 F.P.M. |
| STOCK TEMPERATURE: | @ 57 F.P.M. - Less than 37.8° C. |
| STOCK TEMPERATURE: | @ 22 F.P.M. - 43.3° C. |
| FILTERED REFLECTED ENERGY 16 | - 100% |
| FILTERED DIRECT ENERGY 15 | - 30.5% |
| UNFILTERED DIRECT ENERGY 14 | - 69.5% |

FIG. 5 refers to a mercury vapour lamp 10 with reflector 11 having two hollow quartz tubes 19 beneath the lamp within the reflector, cooling water passes through the tubes 19 which completely seal off the stock side of the reflector. There is no adhesion although the printed material was stationary under lamp.

| | |
|---|---|
| FILTERED REFLECTED ENERGY 16 | - 100% |
| FILTERED DIRECT ENERGY 15 | - 100% |

Tests at varying tube heights for a given ink were conducted with the following results:

TEST RESULTS

| | Test 1 (FIG. 1 equipment) | Test 2 | Test 3 | Test 4 | Test 5 | Test 6 | Test 7 (FIG. 5 equipment) |
|---|---|---|---|---|---|---|---|
| ACCEPTABLE ADHESION OCCURRED AT | 157FPM | 153FPM | 149FPM | 117FPM | 5FPM | 1.5FPM | 0FPM (no adhesion) |
| ACCEPTABLE RESIN POST TACK OCCURRED AT | 117FPM | 110FPM | 100FPM | 38FPM | 22FPM | 9FPM | 0FPM |
| STOCK TEMP. @ 57FPM | 49° C. | 48° C. | 46° C. | 39° C. | 37.8° C. | <37.8° C. | <37.8° C. |
| STOCK TEMP. @ 22FPM | 65.6° C. | 63° C. | 60° C. | 43.3° C. | 41° C. | <37.8° C. | <37.8° C. |
| UNFILTERED DIRECT ENERGY | 100% | 95% | 87% | 76.5% | 69.5% | 50% | 0 |

N.B. 37.8° C. was the lowest temperature readily measured with the available equipment It is evident from the above that as the unfiltered direct energy is decreased (by raising the tube 17), the stock temperature is decreased, and the curing properties (intensity) of the radiation energy are decreased.

The results above show that some filtering is necessary to avoid overheating which results in stock shrinkage, surface wrinkling of the ink and often fire if stock is not continuously moved through the drying (curing) zone. Additionally the closer the lamp reflector and cooling liquid tube to the stock the more intense is the unfiltered direct energy component and the greater the cure but with associated heat problems.

From our experiments therefore the following basic features of our invention have evolved:

(1) Some but not all energy from the light source must be filtered to reduce heat;

(2) the amount of unfiltered direct energy is between 50% and 95% to achieve satisfactory ink cure (adhesion and tack) at acceptable temperatures and feed rates; and (3) preferably the relationship of the centre to centre distance of the lamp to the cooling liquid tube is 52 to 180 mm and the position of the stock surface to lamp centre is 100 to 240 mm for a given 200 watts per linear inch ultra-violet light source.

The present invention more particularly comprises a method and apparatus. The method is for the drying of photo developing ink printed on sheet material and comprises the steps of conveying sheet material printed with photo developing ink through a developing zone below a line source of ultra-violet light, the line of said source lying at an angle to the direction of conveyor movement with a reflector behind the line source so that both direct and reflected ultra-violet rays are directed onto the sheet material, with a transparent heat sink filter for infra-red rays disposed between the sheet material and the ultra-violet light source to filter between 5 and 50% of all of the direct rays from the ultra-violet source.

The apparatus according to the invention comprises a housing, a sheet material conveyor passing through the housing, suction means in the housing to draw the sheet material into contact with the conveyor whilst the sheet material is passing through said housing, a line source of ultra-violet light disposed above the conveyor in the housing with the line of said source at an angle to the direction of conveyor movement, reflector means to reflect ultra-violet rays from the light source onto the conveyor, a heat sink filter for intra-red rays disposed above the conveyor and below the ultra-violet light source and positioned so that between 5 and 50% the direct rays from the ultra-violet light source which would normally impinge on the conveyor in the housing will pass into the heat sink filter.

The invention in a presently preferred form is described with reference to the accompanying drawings in which.

Figure 1:
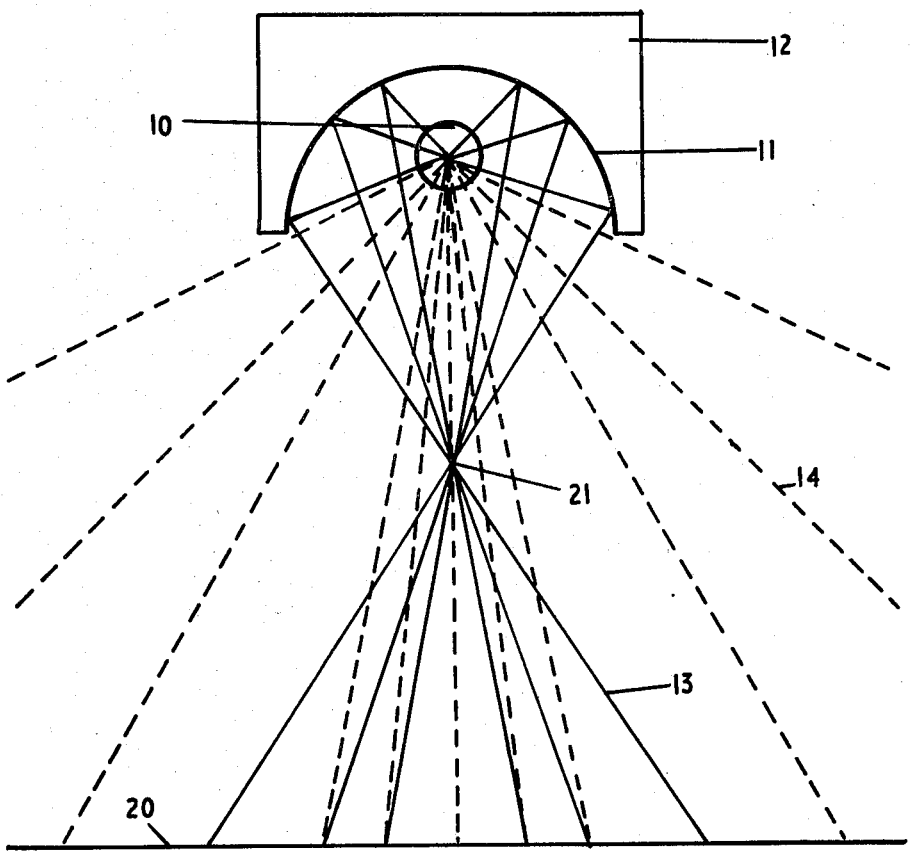
Figure 2:
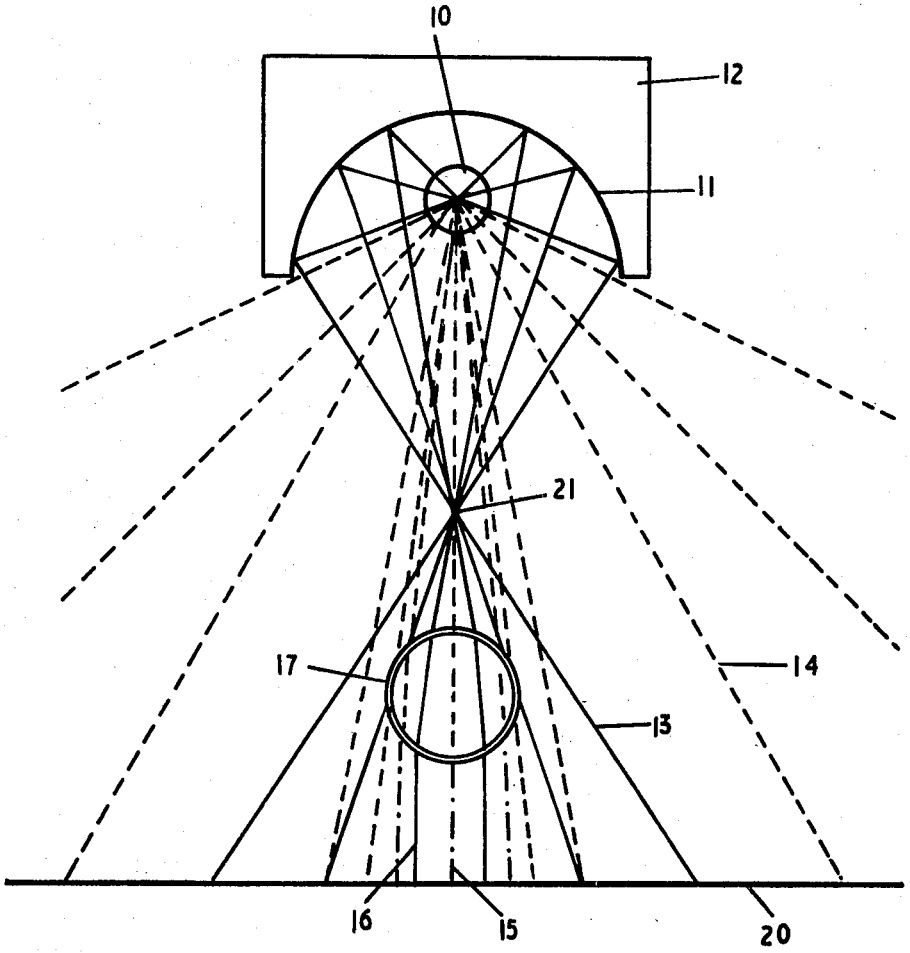
Figure 3:
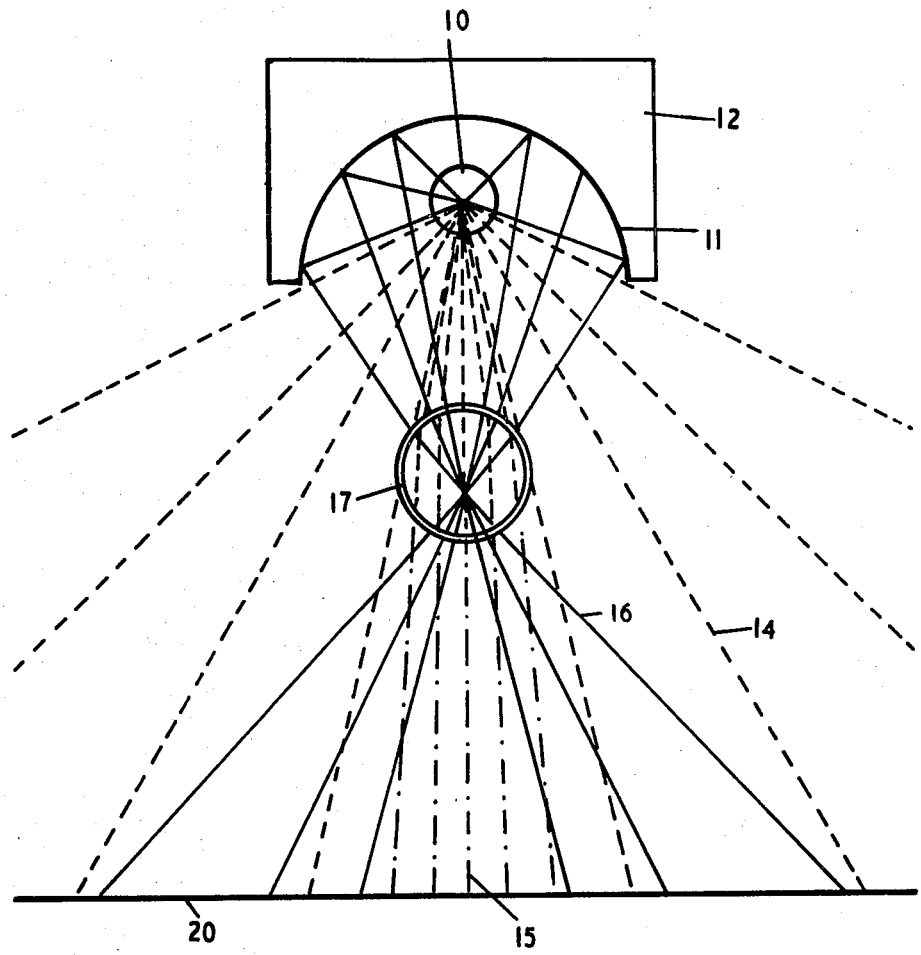
Figure 4:
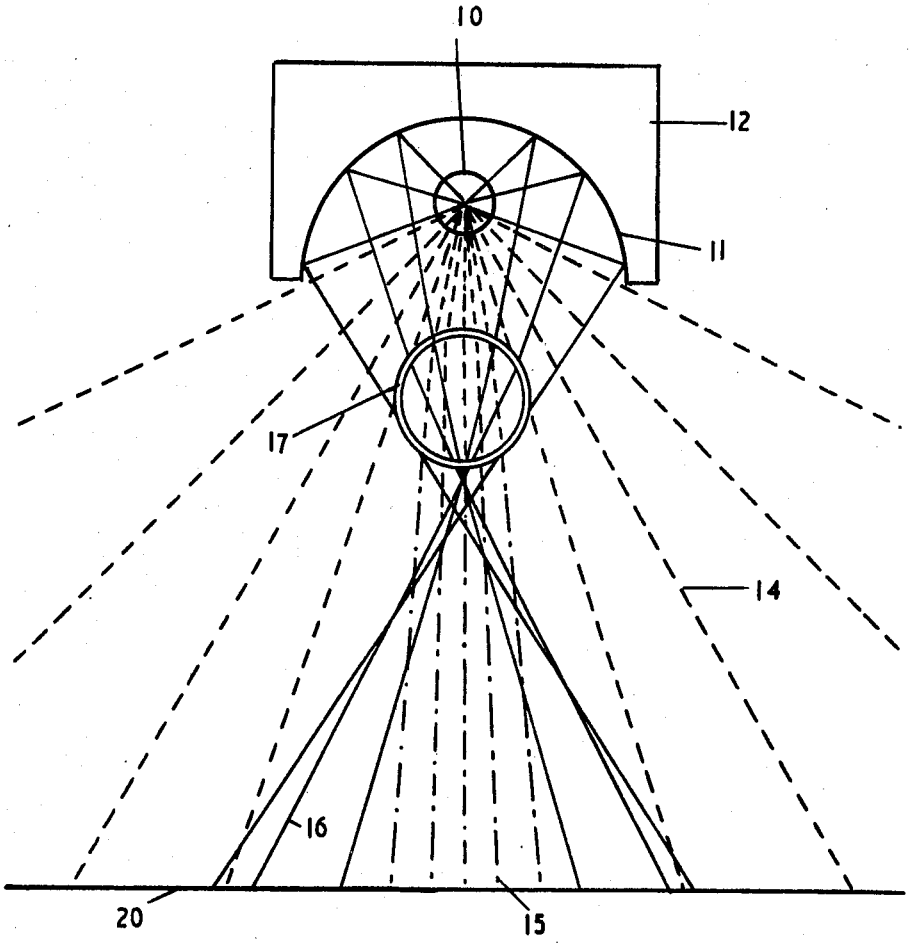
Figure 5:
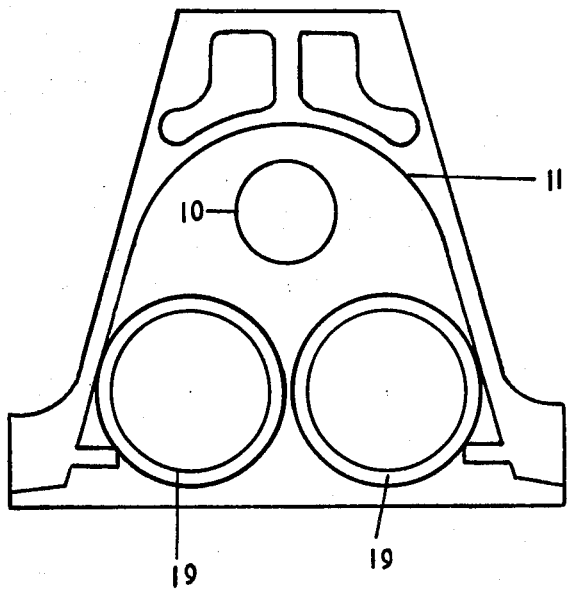
Figure 6:
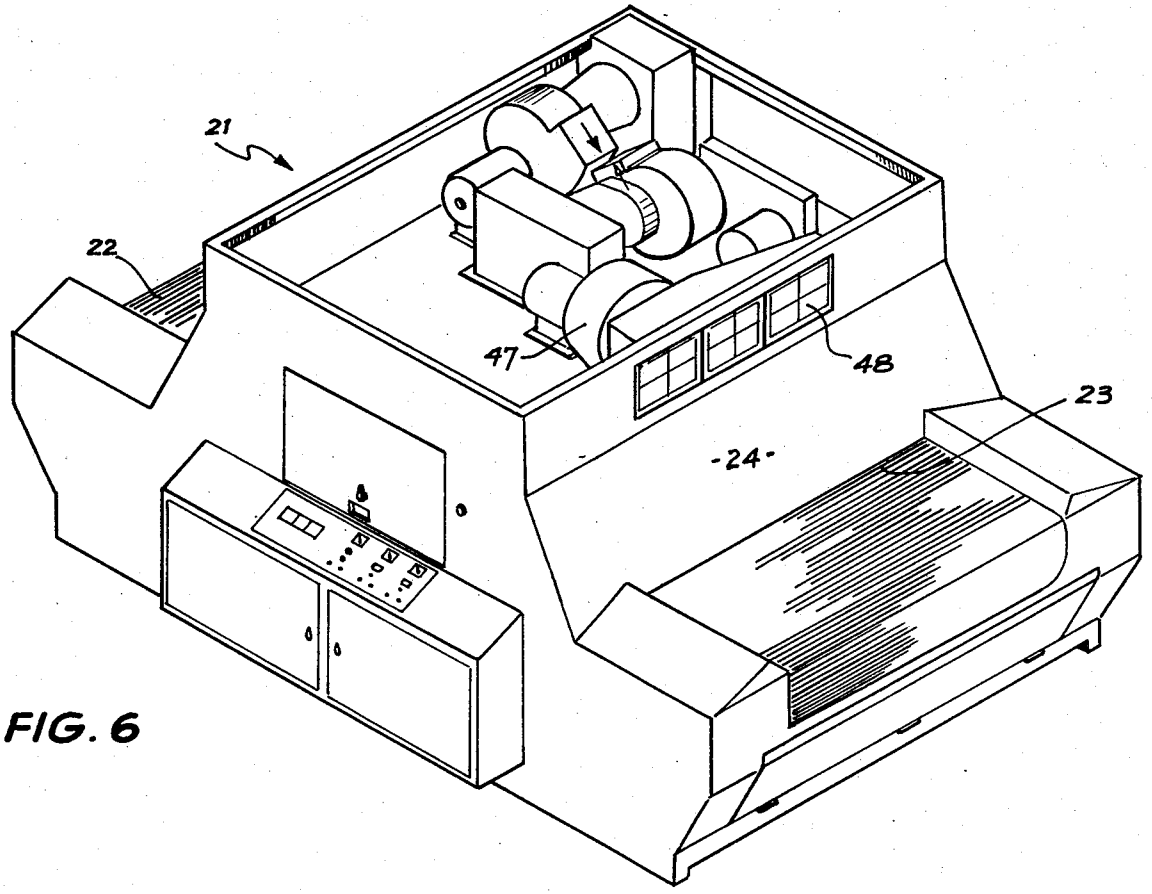
FIG. 6 is a perspective view of apparatus incorporating the invention
Figure 7:
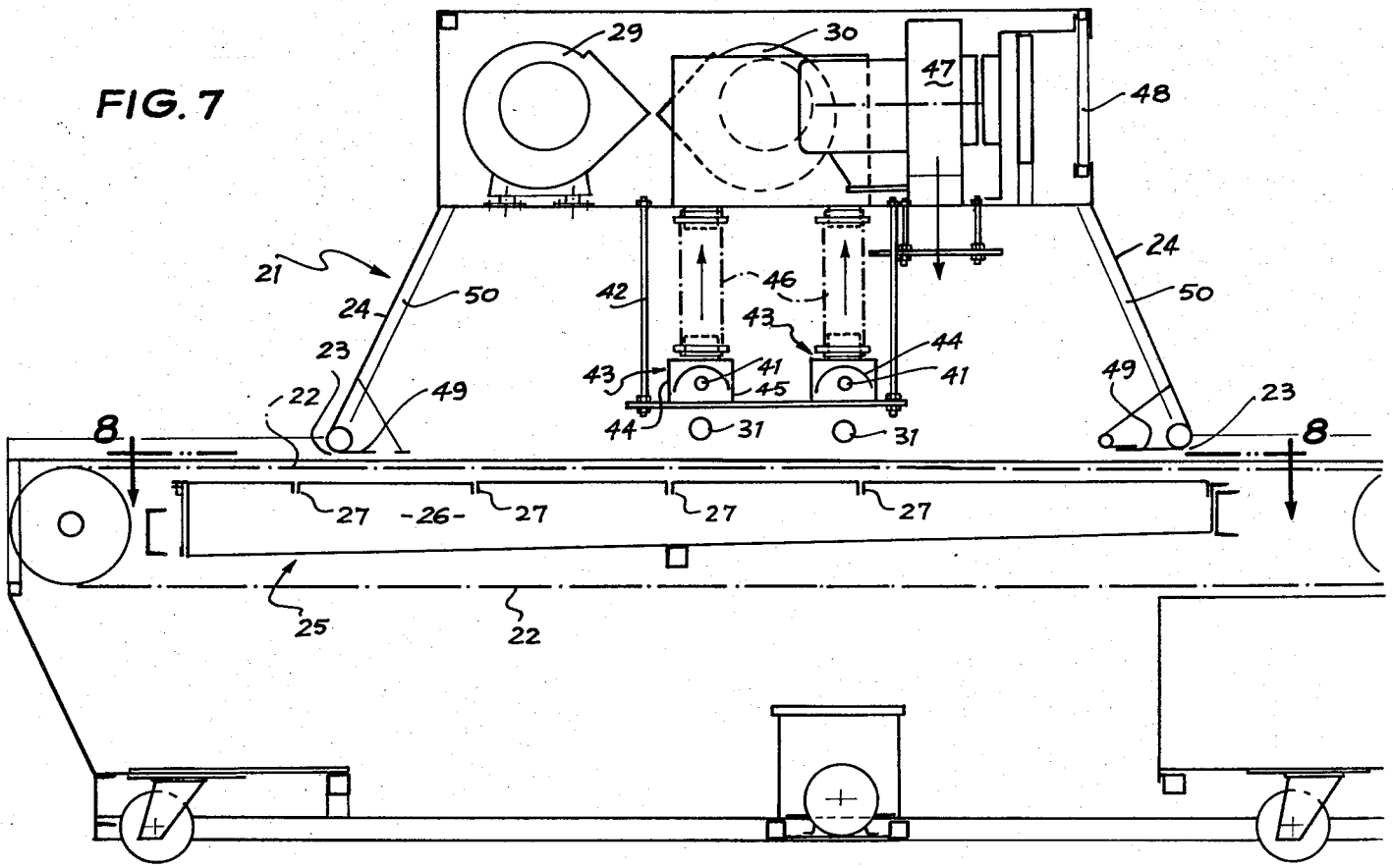
FIG. 7 is a schematic side view of the apparatus of FIG. 6
Figure 8:
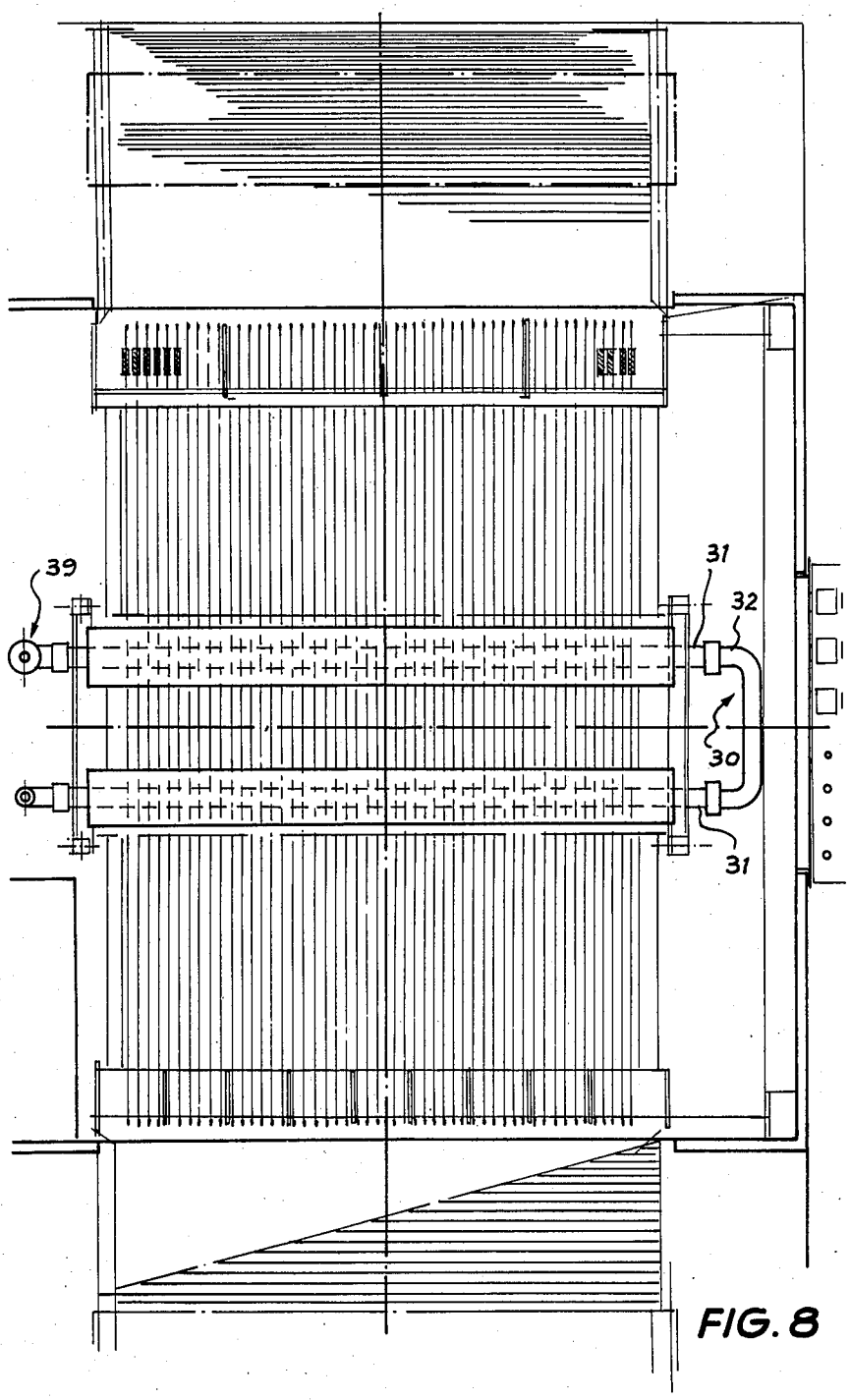
FIG. 8 is a schematic plan view on section line 8—8 of FIG. 7 showing the suction bed and the heat sink
Figure 9:
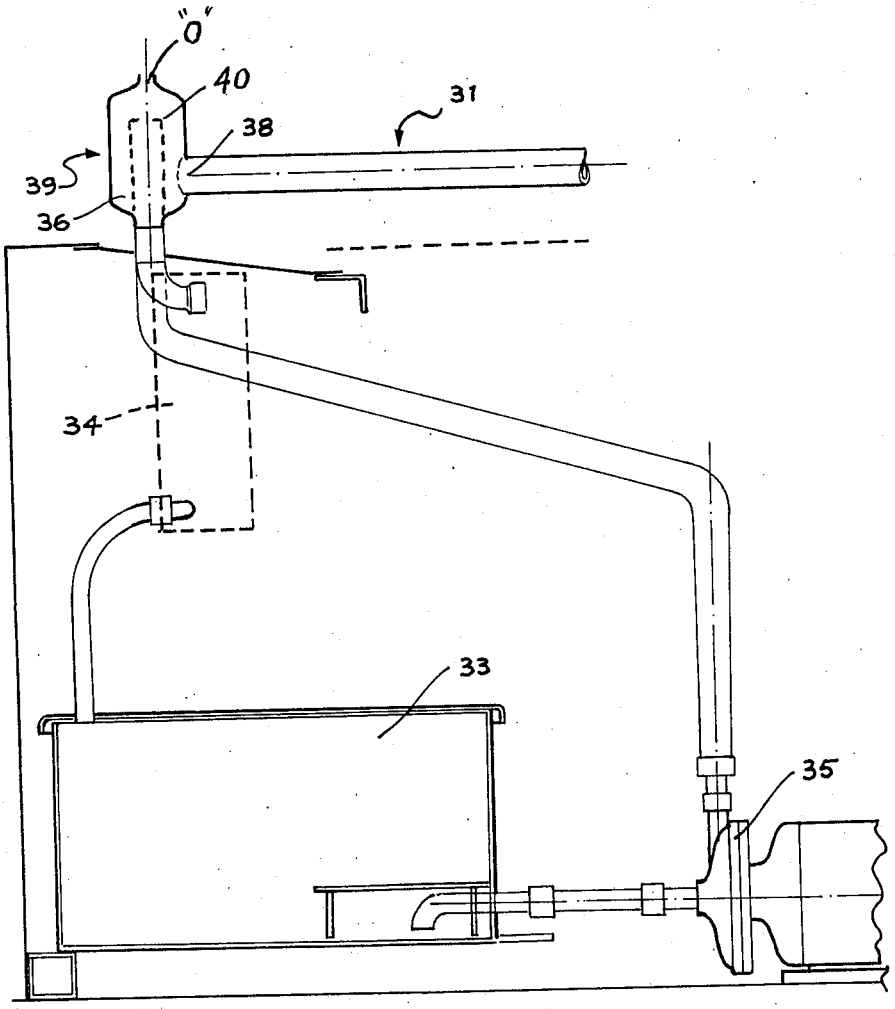
FIG. 9 is a schematic layout of the water cooling system forming part of the heat sink
Figure 10:
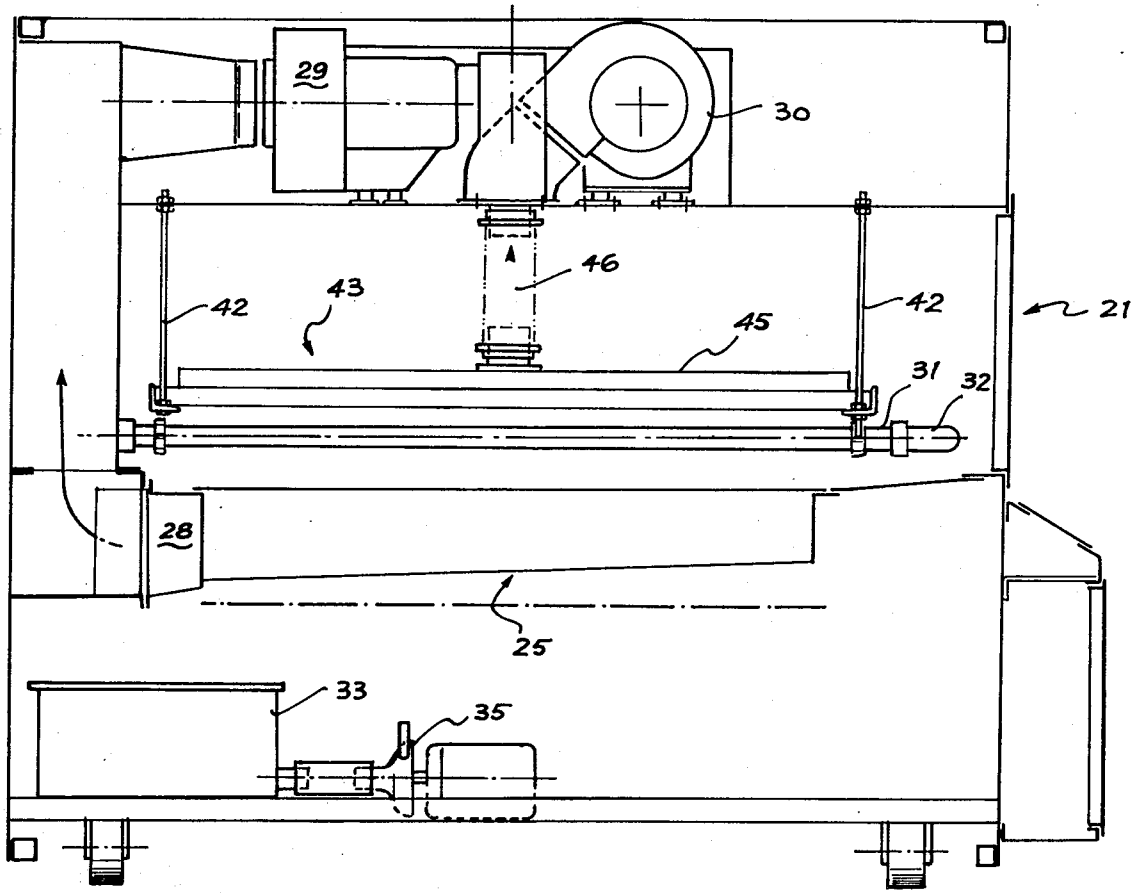
FIG. 10 is a schematic end view showing various components of the apparatus of FIG. 6.

The presently preferred illustrated physical embodiment of the apparatus comprises a housing 21 through which runs an endless conveyor 22 therebeing a slot openings 23 between the conveyor 22 and shroud panels 24 of the housing to permit entry to and exit from the housing of printed sheet material.

Within the housing 21 and immediately below the conveyor 22 there is a suction bed 25 which holds the stock against the conveyor whilst it is in the critical zone below ultra-violet ray source to be described. The suction bed maintains a sheet stock stable whilst it is undergoing ultra-violet light irradiation. Sheet float and flutter which can occur due to the movement of cooling air through the housing is thus avoided. The suction bed 25 is of conventional form and comprises a hollow body 26 with a plurality of transverse suction slots 27. The body 26 is coupled by duct work including a baffle 28 to a suction pump 29.

Above the conveyor is a transparent heat sink filter, for infra-red rays, in the form of a cooling coil 30 made of heat resistant glass tubing of two arms 31 coupled by a U-connector 32. The cooling water is stored in a tank 33 with associated heat exchange cooling means 34. The water is pumped by pump 35 into one leg 31. The discharge from the coil 30 is to a header 39 in which there is a weir means 40 (an inlet end of a feed tube back to the reservoir) which is above the other end 38 of the coil leg 31 to ensure that there is no chance of a discharge sufficient to cause the coil to achieve a "non-full" condition, there is also an air bleed outlet "0".

The other major component of the apparatus is the heat source which comprises two mercury lamps 41 supported from a framework 42 so as to respectively lie directly over and parallel with the cooling coil arms 31 and at a predetermined height thereabove. There is a reflector assembly 43 for each lamp 41. Each reflector assembly comprises a semi-circular reflector 44 to reflect rays which would not normally be incident upon the conveyor back onto the conveyor. There is a backing shroud 45 around the reflector providing an air passage between the shroud 45 and the rear of the reflector 44 for the circulation of cooling air. The air is drawn in from both ends of the shroud 45 by means of a central discharge pipe 46 coupled to suction fan 30.

The air by following the above path passes when coolest over the terminals where the tube ends are connected to the power supply, which are the hottest zones.

Within the housing there is a balanced air condition which is slightly negative with incoming air drawn in by fan 47 through filter 48, air being discharged by fan 30 after cooling the tubes and being discharged by fan 29 after passing through the vacuum table 25. The balance of incoming and outgoing air is achieved by the baffle 28 in the duct to fan 29. There is a continuous generation of ozone by the operation of the tubes and this is exhausted through fans 29 and 30.

The spacing between the centre of lamp 41 and the reflector, between the lamp and the cooling coil and between the cooling coil and sheet stock is predetermined in accordance with the foregoing theoretical considerations.

Several special features are included as preferments in the present embodiment. The shrouds 24 have return flanges 49 which have a matt black finish to trap light, the inner surfaces 50 of the shrouds 24 are reflective and the angle of the shrouds is such as to collect as many scattered rays as possible and reflect them back onto the conveyor. The ideal situation is one in which the housing is a substantially complete light trap with substantially no escape of ultra-violet light.

I claim:

1. Apparatus to dry photodeveloping ink printed on sheet material, said apparatus comprising a housing, a sheet material conveyor passing through the housing, suction means in the housing to draw sheet material into contact with the conveyor whilst the sheet material is passing through the housing, a line source of ultra-violet light in the housing with the line of said source extending laterally across the conveyor and directing the rays therefrom toward the conveyor, reflector means to reflect ultra-violet rays from the light source onto the conveyor, a transparent heat sink filter for infra-red rays disposed between the conveyor and the ultra-violet light source and adapted for filtering between about 20% and 30% of the direct infra-red rays and substantially all of the reflected infra-red rays from the ultra-violet light source which would normally impinge on the conveyor within the housing.

2. Apparatus as claimed in claim 1 wherein the heat sink filter is a transparent glass tube through which a fluid cooling medium is continuously passed.

3. Apparatus as claimed in claim 2 wherein the cooling medium is water.

4. Apparatus as claimed in claim 3 including a closed cooling system coupled to the heat sink tube; means for circulating cooling water in the closed cooling system; and weir means for ensuring that the heat sink tube is always completely filled.

5. Apparatus as claimed in claim 4 wherein the closed cooling system includes an air trap to ensure that air is not included in the cooling medium.

6. Apparatus as claimed in claim 4 wherein the closed cooling system includes a heat exchanger to remove heat from the cooling medium.

7. Apparatus as claimed in claim 1 including mounting means for mounting the ultra-violet light source and duct means located in the mounting means for passing cooling air on the opposite side of the ultra-violet light source from the conveyor.

8. Apparatus as claimed in claim 1 wherein the ultra-violet light source comprises a mercury vapor tube lamp of 200 watts linear inch, the distance from the ultra-violet light source to the heat sink filter is 52 to 180 mms. and the distance from the heat sink filter to the conveyor is 100 to 240 mms.

9. Apparatus as claimed in claim 1 wherein there is more than one ultra-violet light source each with an associated heat sink filter means.

10. Apparatus as claimed in claim 1 wherein the housing is maintained at a negative pressure.

11. Apparatus as claimed in claim 1 wherein the filter is formed from transparent quartz glass.

12. A method of drying photo-developing inks on printed sheet material in a machine having a conveyor to carry such printed sheet material through a developing zone, a reflector backed line source of ultra-violet light extending laterally across the conveyor and directing the rays therefrom toward the conveyor and a transparent heat sink disposed between the ultra-violet light source and the conveyor, the method comprising the step of utilizing the heat sink for filtering about 20% to 30% of all direct infra-red rays and substantially all of the reflected infra-red rays emitted from the ultra-violet light source toward the conveyor.

13. Apparatus to dry photo-developing ink printed on sheet material, said apparatus comprising a housing, a sheet material conveyor passing through the housing, suction means in the housing to draw sheet material into contact with the conveyor whilst the sheet material is passing through the housing, a line source of ultra-violet light in the housing with the line of said source extending laterally across the conveyor and directing the rays therefrom toward the conveyor, reflector means to reflect ultra-violet rays from the light source through a focal point onto the conveyor, a transparent heat sink filter for infra-red rays disposed between the conveyor and the ultra-violet light source and adapted for filtering between about 20% and 30% of the direct infra-red rays and substantially all of the reflected rays from the ultra-violet light source which would normally impinge on the conveyor within the housing.

14. Apparatus to dry photo-developing ink printed on sheet material, said apparatus comprising a housing, a sheet material conveyor passing through the housing, suction means in the housing to draw sheet material into contact with the conveyor whilst the sheet material is passing through the housing, a line source of ultra-violet light in the housing with the line of said source extending laterally across the conveyor and directing the rays therefrom toward the conveyor, reflector means to reflect ultra-violet rays from the light source through a focal point onto the conveyor, a transparent heat sink filter for infra-red rays disposed between the conveyor and the ultra-violet light source and positioned so that substantially all of the reflected light rays impinge upon the filter.

15. Apparatus to dry photo-developing ink printed on sheet material, said apparatus comprising a housing, a sheet material conveyor passing through the housing, suction means in the housing to draw sheet material into contact with the conveyor whilst the sheet material is passing through the housing, a line source of ultra-violet light in the housing with the line of said source extending laterally across the conveyor and directing the rays therefrom toward the conveyor, reflector means to reflect ultra-violet rays from the light source through a focal point onto the conveyor, a transparent heat sink filter for infra-red rays disposed between the conveyor and the ultra-violet light source, said filter positioned substantially at the focal point and adapted for filtering between about 20% and 30% of the direct infra-red rays from the ultra-violet light source which would normally impinge on the conveyor within the housing.

* * * * *

UNITED STATES PATENT AND TRADEMARK OFFICE

CERTIFICATE OF CORRECTION

PATENT NO. : 4,222,177

DATED : September 16, 1980

INVENTOR(S) : Ronald M. Mason

It is certified that error appears in the above—identified patent and that said Letters Patent is hereby corrected as shown below:

Column 1, Line 14, "4,00,407" should read -- 4,000,407 --. Column 2, Lines 48, 50, 52 and 54, the chart should read as follows:

| | |
|---|---|
| Rays shown _____ | and identified 16 indicate REFLECTED, FILTERED RAYS |
| Rays shown _____ | and identified 13 indicate REFLECTED UNFILTERED RAYS |
| Rays shown ---------- | and identified 14 indicate DIRECT UN-FILTERED RAYS |
| Rays shown -·-·-·-·-·-·- | and identified 15 indicate DIRECT FILTERED RAYS |

Line 58, "76.2 m" should read -- 76.2 mm --. Column 5, Line 36, "intra-red" should read -- infra-red --; Line 38, after "50%" insert -- of --; Line 57, after "therebeing" delete "a". Column 6, Claim 1, Line 59, "photodeveloping" should read -- photo-developing --.

Signed and Sealed this

Tenth Day of March 1981

[SEAL]

Attest:

RENE D. TEGTMEYER

Attesting Officer

Acting Commissioner of Patents and Trademar